United States Patent [19]

Royce et al.

[11] 4,146,948

[45] Apr. 3, 1979

[54] CASKET

[75] Inventors: Elliott F. Royce, 2517 Huntingdon Ave., Minneapolis, Minn. 55416; Jeff L. Royce; Alan S. Briskin, both of Minneapolis; James W. Ogland, Wayzata, all of Minn.

[73] Assignee: Elliott F. Royce, Minneapolis, Minn.

[21] Appl. No.: 843,337

[22] Filed: Oct. 18, 1977

[51] Int. Cl.[2] ..... A61G 17/00

[52] U.S. Cl. ..... 27/2; 27/5, 217 12 R

[58] Field of Search ..... 27/2, 4, 5, 14, 15, 27/17, 10; 217/5, 12 R

[56] References Cited

U.S. PATENT DOCUMENTS

| | | | |
|---|---|---|---|
| 76,376 | 4/1868 | Arery et al. | 27/2 |
| 595,462 | 12/1897 | Snader | 27/5 |
| 686,308 | 11/1901 | Kregel | 27/2 |

FOREIGN PATENT DOCUMENTS

| | | | |
|---|---|---|---|
| 344905 | 12/1921 | Fed. Rep. of Germany | 27/5 |
| 747052 | 1/1944 | Fed. Rep. of Germany | 27/2 |

*Primary Examiner*—John D. Yasko

*Attorney, Agent, or Firm*—Wicks & Nemer

[57] ABSTRACT

Casket according to the teachings of the present invention is disclosed including, a bottom, a first side, a second side, a first end, a second end, and a top. The parts of the casket are longitudinally, slidably interconnected together such that each successive part of the casket interfits and interlocks with the others. Thus the bottom, sides, ends, and top interfit in a fashion that the assembly of the top locks the bottom, sides, and ends and prevents movement of the bottom, sides, and ends in any direction to form a rigid, unitary, complete casket obviating the necessity of any further fastening elements of any kind. In the preferred embodiment, no hardware of any kind is required in the assembly of the casket. Therefore, the casket according to the teachings of the present invention meets certain religious requirements and allows a dignified burial while avoiding excessive costs. Handle members are further provided formed from rope members threaded through apertures with the ends of the rope member being cinched between apertures such that no knots are required in forming secure handles.

25 Claims, 10 Drawing Figures

CASKET

BACKGROUND

The present invention relates generally to caskets and more specifically to caskets which do not require the use of nails or hardware of any kind.

Certain religious requirements exist that caskets used in burial required no nails, hardware, or non-naturally occurring material of any kind. With the increasing costs of labor and material in constructing such caskets, a need has arisen for a casket which, while meeting these religious requirements, can be stored flat prior to use, can be easily assembled by two people, and can be easily manufactured from inexpensive material, while still allowing the assembled casket to be highly functional, yet be of an aesthetic appearance, and allow a dignified burial, while avoiding excessive costs.

SUMMARY

The casket of the present invention solves these and other problems by providing, in the preferred embodiment, a bottom, a first side, a second side, a first end, a second end, and a top. The parts of the casket, according to the teachings of the present invention interfit, in a fashion that the assembly of the last part locks all preceeding parts and prevents movement of the preceeding parts in any direction to form a rigid, unitary, complete casket obviating the necessity of any further fastening elements of any kind.

Also, the casket of the present invention further provides, in the preferred embodiment, handle members comprised of rope members that are attached to the casket without the use of knots.

It is thus a primary object of the present invention to provide a novel casket.

It is further an object of the present invention to provide such a casket that meets certain religious requirements that no nails, hardware, or non-naturally occurring material be used.

It is further an object of the present invention to provide such a casket having components that can be stored flat in a carton prior to use, are easily manufactured from inexpensive material, and can be easily assembled by two people, while still allowing the assembled casket to be highly functional, yet be of an aesthetic appearance.

It is further an object of the present invention to provide such a casket which allows a dignified burial while avoiding excessive costs.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
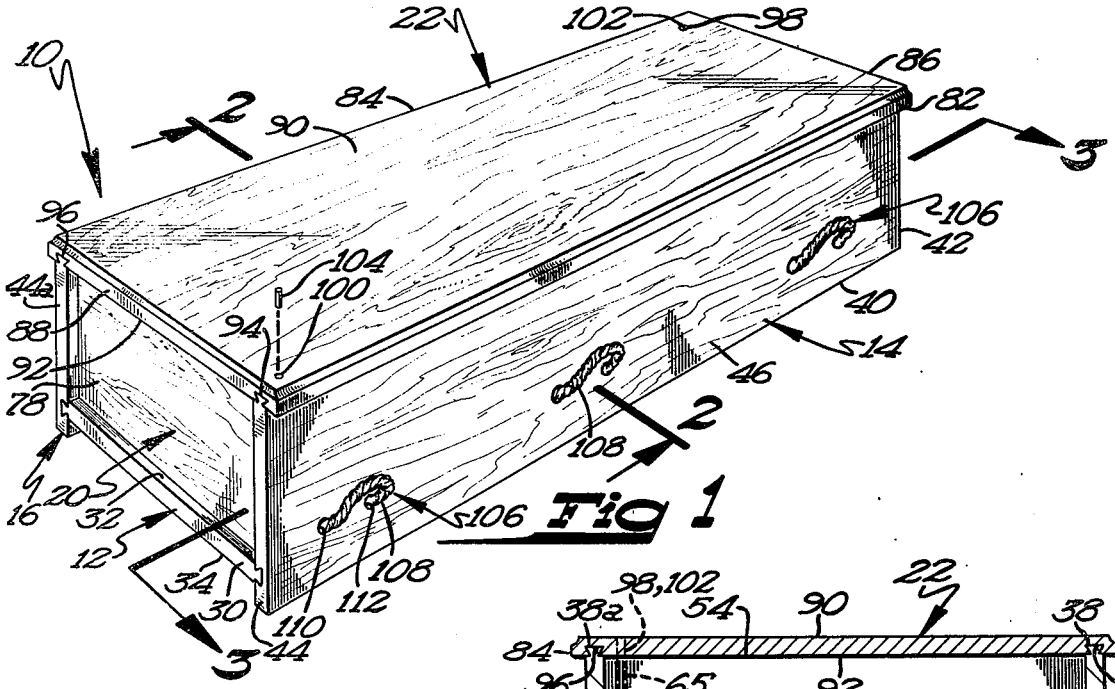
FIG. 1 shows a perspective view of a casket according to the teachings of the present invention.
Figure 4:
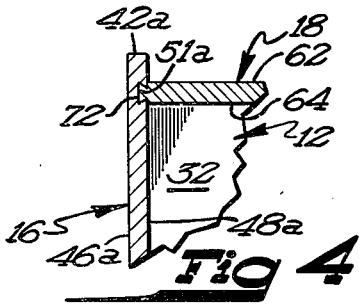
FIG. 4 shows a partial cross-sectional view of the casket of FIG. 1 according to section line 4—4 of FIG. 2.
Figure 2:
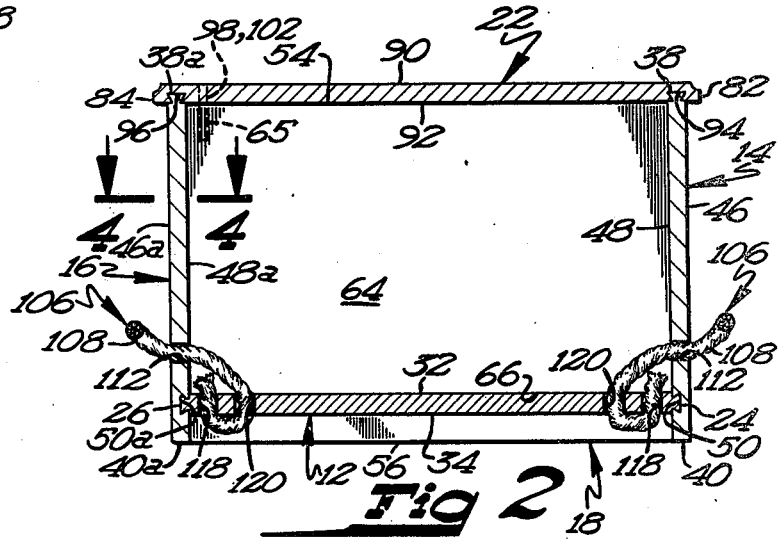
FIG. 2 shows a cross-sectional view of the casket of FIG. 1 according to section line 2—2 of FIG. 1.
Figure 3:
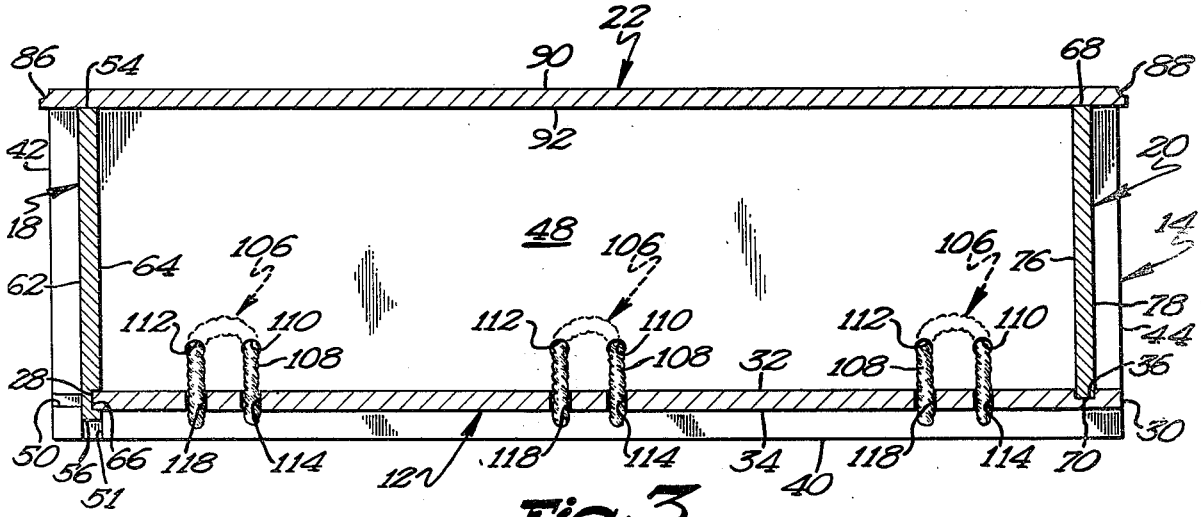
FIG. 3 shows a cross-sectional view of the casket of FIG. 1 according to section line 3—3 of FIG. 1.
Figure 5:
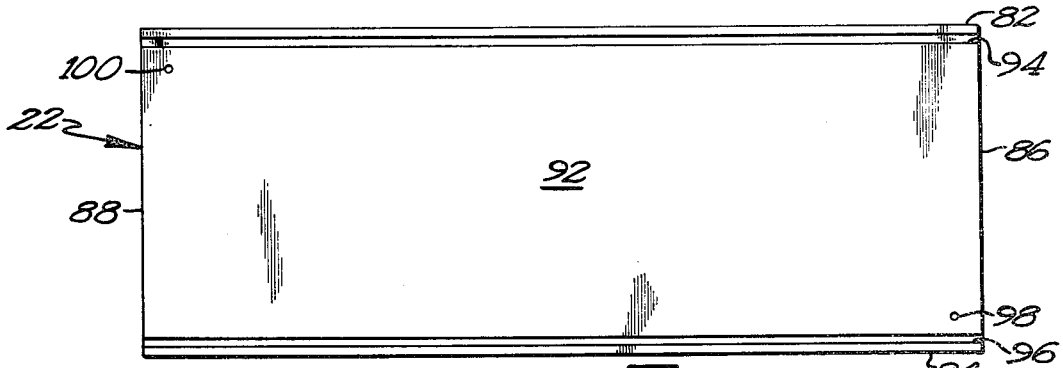
FIGS. 5-10 show plan views of the components of the casket of FIG. 1.
Figure 6:
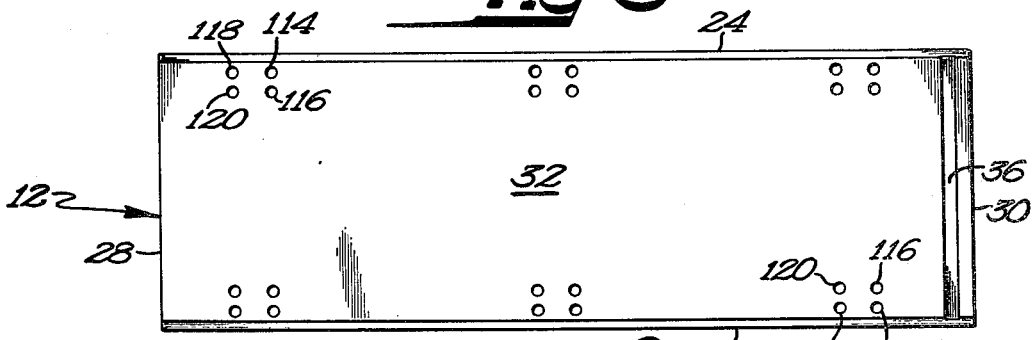
Figure 7:
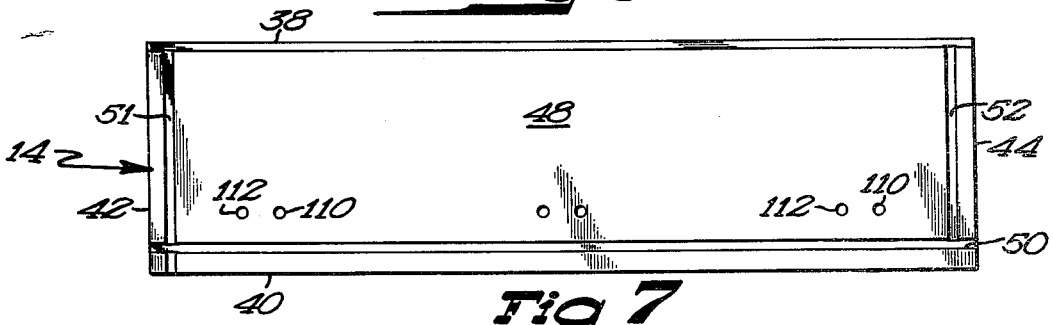
Figure 8:
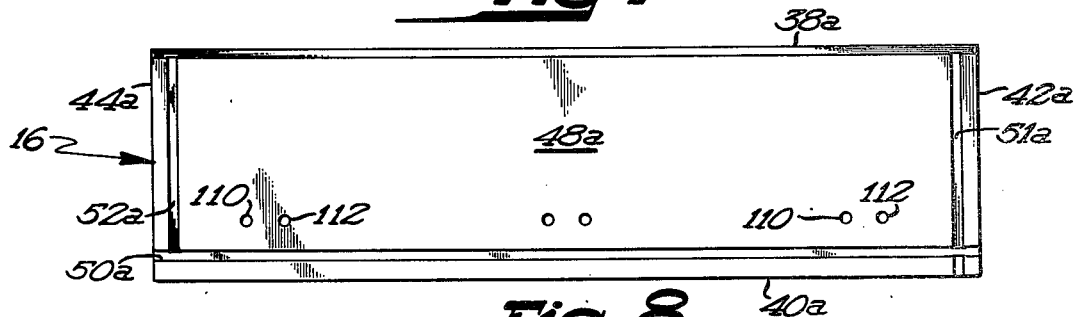
Figure 9:
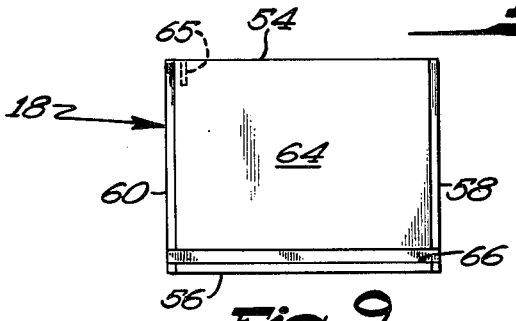
Figure 10:
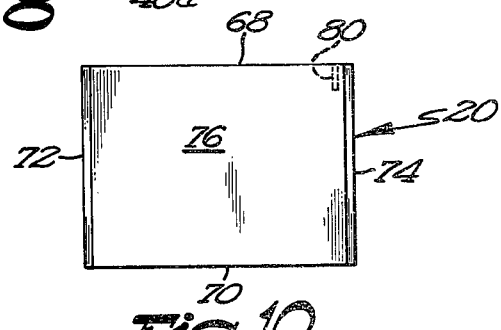

All figures are drawn for ease of explanation of the basic teachings of the present invention only; the extensions of the figures with respect to number, position, relationship, and dimensions of the parts to form the preferred embodiment will be explained.

Where used in the various figures of the drawings, the same or similar numerals designate the same or similar parts of the various members of the casket. Furthermore, when the terms "top", "bottom", "first", "second", "third", "fourth", "fifth", "sixth", "horizontal", and similar terms are used herein, it should be understood that these terms have reference only to the structure shown in the drawings, as it would appear to a person viewing the drawings, and are utilized only to facilitate describing the invention.

DESCRIPTION

In the figures, a preferred embodiment of a casket according to the teachings of the present invention is shown and generally designated 10. Casket 10 is shown including a bottom 12, a first side 14, a second side 16, a first end 18, a second end 20, and a top 22. In the preferred embodiment, bottom 12, sides 14 and 16, ends 18 and 20, and top 22 are formed from three-quarter inch pressed board, three-quarter inch laminated wood, or three-quarter inch oak veneered pressed board.

Bottom 12 includes a first side edge 24, a second side edge 26, a first end edge 28, a second end edge 30, a top surface 32, and a bottom surface 34. In the preferred embodiment, first and second side edges 24 and 26 are dove tailed as shown for purposes to be explained further hereinafter. A straight-walled groove 36 is further provided in top surface 32 parallel to and slightly spaced from second end edge 30 for purposes to be explained further hereinafter. First and second end edges 28 and 30 may have any desired shape, for example the square edges as shown.

First side 14 includes a top edge 38, a bottom edge 40, a first end edge 42, a second end edge 44, an outside surface 46, and an inside surface 48. Second side 16 likewise includes a top edge **38*a*, a bottom edge 40*a*, a first end edge 42*a*, a second end edge 44*a*, an outside surface 46*a*, and an inside surface 48*a*. Formed on inside surfaces 48 and 48*a* of sides 14 and 16 are first dove tailed grooves 50 and 50*a* parallel to and slightly spaced from bottom edges 40 and 40*a*, respectively, second dove tailed grooves 51 and 51*a* parallel to and slightly spaced from first end edges 42 and 42*a* of sides 14 and 16 and perpendicular to grooves 50 and 50*a*, respectively, and third dove tailed grooves 52 and 52*a* parallel to but slightly spaced from second end edges 46 and 46*a* of sides 14 and 16, perpendicular to grooves 50 and 50*a*, and parallel to grooves 51 and 51*a*, respectively. It should then be noted that in the preferred embodiment, grooves 51 and 51*a* extend from top edges 38 and 38*a* to and terminating in bottom edges 40 and 40*a* of sides 14 and 16, respectively. In the preferred embodiment, grooves 52 and 52*a* extend from top edges 38 and 38*a* to and terminating in grooves 50 and 50*a* and do not extend or intersect with bottom edge 40 and 40*a* of sides 14 and 16, respectively. Bottom edges 40 and 40*a*, and end edges 42, 42*a*, 44, and 44*a* can have any desired shape, for example the square edges as shown. It can then be appreciated that side 16 is a mirror image of side 14** in the preferred emobdiment.

First end 18 includes a top edge 54, a bottom edge 56, a first side edge 58, a second side edge 60, an outside surface 62, and an inside surface 64. In the preferred embodiment, end edges 58 and 60 of end 18 are dove tailed for purposes to be explained further hereinafter. A straight-walled groove 66 is formed on inside surface 64 parallel to and slightly spaced from bottom edge 56 for purposes to be explained further hereinafter. Top edge 54 has a square edge and includes a bore 65, shown in its preferred form as having a circular cross-section, having its longitudinal axis spaced from and parallel to edge 60 for purposes to be explained further hereinafter. Bottom edge 56 can have any desired shape and may have the shape of bottom edges 40 and 40*a* of sides 14 and 16, for example the square edges as shown.

End 20 includes a top edge 68, a bottom edge 70, a first side edge 72, a second side edge 74, an inside surface 76, and an outside surface 78. In the preferred embodiment, edges 72 and 74 are dove tailed for purposes to be explained further hereinafter. Top and bottom edges 68 and 70 are square for purposes to be explained further hereinafter. Top edge 68 includes a bore 80 having a circular cross-section, having its longitudinal axis spaced from and parallel to edge 72 for purposes to be explained further hereinafter.

Top 22 includes a first side edge 82, a second side edge 84, a first end edge 86, a second end edge 88, an outside surface 90, and an inside surface 92. Top 22 includes a first dove tailed groove 94 located parallel to but slightly spaced from first side edge 82 and a second dove tailed groove 96 located parallel to but spaced from second side edge 84. Grooves 94 and 96 are formed on the inside surface 92 of top 22. Top 22 further includes a first bore 98, having a circular cross-section in the preferred embodiment, extending from surface 90 to surface 92 at a location corresponding to bore 65 of end 18 when casket 10 is in an assembled relation, as will be explained further hereinafter. Top 22 additionally includes a second bore 100, having a circular cross-section in the preferred embodiment, extending from surface 90 to surface 92 at a location corresponding to bore 80 of end 20 when casket 10 is in an assembled relation, as will be explained further hereinafter.

A first dowel 102 is provided corresponding to and for receipt within bores 65 and 98, and further, a second dowel 104 is provided corresponding to and for receipt in bores 80 and 100, for purposes to be explained further hereinafter.

Handle members 106 are further provided and located along the length of casket 10 and, in the preferred embodiment, include six members 106. Handle members 106 include a rope member 108, having a first end, and include a second end and a first aperture 110 and a second aperture 112 spaced horizontally from aperture 110, both formed in sides 14 or 16. Members 106 further include a third aperture 114 and a fourth aperture 116 spaced from aperture 114 formed in bottom 12. Apertures 114 and 116 are located along a line parallel to end edges 28 and 30 of bottom 12 corresponding to aperture 110. Members 106 further include a fifth aperture 118 and a sixth aperture 120 spaced from aperture 118 formed in bottom 12. Apertures 118 and 120 are located along a line parallel to end edges 28 and 30 of bottom 12 corresponding to aperture 112.

In the preferred embodiment of the present invention, the first end of rope member 108 is located within aperture 114 and extends exteriorly of casket 10. Rope member 108 is then threaded through aperture 116 into the interior of casket 10, through aperture 110 to the exterior of casket 10, through aperture 112 into the interior of casket 10, and through aperture 120 to the exterior of casket 10. The second end of rope member 108 is located in aperture 118. It should then be noted that rope member 108 is cinched between apertures 114 and 116 and apertures 118 and 120 such that no knots are required on the first and second ends of rope member 108. It should then be noted that rope member 108 should be of a sufficient length so that a loop is formed exteriorly or outside of casket 10 between apertures 110 and 112 for grasping by a person for use as a handle in carrying casket 10.

Now that the structural details of the components of casket 10 have been set forth, the method of assembly will be explained and the advantages of the present invention can better be appreciated. Bottom surface 34 of bottom 12 is first set on a flat surface, and in the preferred embodiment, is set on a block or other object having an area considerably lesser than the area of bottom surface 34. Side 14 is then positioned such that first side edge 24 of bottom 12 aligns with groove 50 of first side 14. Side 14 is then slid onto bottom 12 such that edge 24 of bottom 12 is longitudinally slidably received within groove 50 of side 14. Similarly, second side 16 is positioned such that second side edge 26 of bottom 12 aligns with groove 50*a* of second side 16. Side 16 is then slid onto bottom 12 such that second side edge 26 of bottom 12 is longitudinally slidably received within groove 50*a* of side 16. It should then be noted that the dove tailed edges 24 and 26 of bottom 12 and the dove tailed grooves 50 and 50*a* of sides 14 and 16 allow for longitudinally, slidably interlocking of sides 14 and 16 to bottom 12 and for preventing movement of sides 14 and 16 relative to bottom 12 in all directions other than its longitudinal.

It should be noted that sides 14 and 16 should be positioned on bottom 12 such that end edge 28 of bottom 12 is located on the side of grooves 51 and 51*a* opposite ends 42 and 42*a* of sides 14 and 16. First end 18 is then positioned such that first side edge 58 aligns with groove 51 of side 14 and second side edge 60 aligns with groove 51*a* of side 16. End 18 is then slid within sides 14 and 16 such that edges 58 and 60 of end 18 are longitudinally slidably received within grooves 51 and 51*a* of sides 14 and 16, respectively. It should then be noted that the dove tailed edges 58 and 60 of end 18 and dove tailed grooves 51 and 51*a* of side 14 and 16 allow for longitudinally, slidably interlocking of end 18 to sides 14 and 16, respectively and for preventing movement of end 18 relative to sides 14 and 16 in all directions other than its longitudinal.

At this time, bottom 12 can be further slid within sides 14 and 16 such that end edges 28 of bottom 12 is located and captured within groove 66 of end 18. It should then be noted that groove 66 of end 18 has a shape complementary to the shape of end edge 28 of bottom 12. Additionally, it should be noticed that end edge 28 of bottom 12 is positioned within groove 66 of end 18 for blocking end 18 such that longitudinal movement of end 18 within sides 14 and 16 is prevented. Furthermore, end edge 28 of bottom 12 abuts end 18 within groove 66 for blocking bottom 12 such that bottom 12 is prevented from being longitudinally, slidably moved within sides 14 and 16 in a first direction towards end 18.

End 20 is then positioned such that first side edge 72 is aligned with groove 52 of side 14 and second side edge 74 is aligned with groove 52*a* of side 16. At this time, end 20 is slid within sides 14 and 16 such that edges 72 and 74 are longitudinally slidably received within grooves 52 and 52*a* of sides 14 and 16, respectively. End 20 is positioned such that bottom edge 70 of end 20 is located within groove 36 of bottom 12. It should then be noted that dove tailed edges 72 and 74 and dove tailed grooves 52 and 52*a* of sides 14 and 16 allow for longitudinally, slidably interlocking of end 20 to sides 14 and 16 of casket 10 and for preventing movement of end 20 relative to sides 14 and 16 in all directions other than its longitudinal. Additionally, bottom edge 70 of end 20 is positioned within groove 36 of bottom 12 for blocking bottom 12 such that longitudinal movement of bottom 12 within sides 14 and 16 is prevented. It should then also be noted that since edge 70 of end 20 abuts with groove 36 of bottom 12, end 20 is prevented from moving beyond bottom 12.

Top 22 can then be positioned such that edge 38 of side 14 aligns with groove 94 and edge 38*a* of side 16 aligns with groove 96 of top 22. Top 22 can then be slid such that edges 38 and 38*a* of sides 14 and 16 are longitudinally slidably received within grooves 94 and 96 of top 22, respectively. It should then be noted that dove tailed edges 38 and 38*a* of sides 14 and 16 and dove tailed grooves 94 and 96 of top 22 allow for longitudinally, slidably interconnecting of top 22 to sides 14 and 16 and for preventing movement of top 22 relative to sides 14 and 16 in all directions other than its longitudinal. It should then also be noted that edge 78 of end 20 abuts with top 22 and therefore prevents movement of end 20 past top 22.

Dowel 102 can then be positioned within bore 98 of top 22 and bore 65 of end 18 and dowel 104 can be positioned within bore 100 of top 22 and bore 80 of end 20. Dowels 102 and 104 and bores 65, 80, 98, and 100 therefore allow for blocking longitudinal movement of top 22 with respect to sides 14 and 16 and therefore stop the longitudinal movement of top 22 with respect to sides 14 and 16 of casket 10.

It should now be noted that, according to the teachings of the present invention, the bottom, sides, ends, and top interfit in a fashion that the assembly of the last part, for example top 22 as shown in the preferred embodiment, locks all preceeding parts, for example as shown in the preferred embodiment, bottom 12, sides 14 and 16, and ends 18 and 20, and prevents movement of the preceeding parts in any of their longitudinal directions to form a rigid, unitary, complete casket obviating the necessity of any further fastening elements of any kind. It should then be further noted that the longitudinal movement of the last part, for example top 22 as shown in the preferred embodiment, can further be blocked, as by dowels 102 and 104 and bores 65, 80, 98, and 100 as in the preferred embodiment.

It can then be appreciated that the present invention allows a dignified burial while avoiding excessive cost. The present invention further meets certain religious requirements that no nails, hardware, or other materials not naturally occurring be used in caskets.

Additionally, it should be noted that the components of the casket according to the teachings of the present invention can be stored flat in a carton prior to use, are easily manufactured from inexpensive material, and can be easily assembled by two people, while still allowing the assembled casket to be highly functional, yet be of an aesthetic appearance.

Now that the basic teachings of the present invention have been explained, many extensions and variations will be obvious to one having ordinary skill in the art. For example, although, in the preferred embodiment, dove tailed edges and grooves are shown to allow for longitudinally slidably interconnecting of the parts and for preventing movement of the parts in all directions other than their longitudinal, other types of connections will become obvious to a person skilled in the art after the present invention is known and understood.

Furthermore, although in the preferred embodiment, end 18 interfits with bottom 12 and sides 14 and 16 such that end edge 28 of bottom 12 extends into groove 66 of end 18 for providing a strong connection, end 18 could interfit with bottom 12 and sides 14 and 16 in a manner analogous to the interfitting of end 20 thereto. Thus, ends 18 and 20 could be identical in design and size. Additionally, it should be noted that ends 18 and 20 could be positioned such the end edge 28 of bottom 12 abuts against surface 64 of end 18, end edge 30 of bottom 12 abuts against surface 76 of end 20, bottom edge 56 of end 18 and bottom edge 70 of end 20 abut against the material located between grooves 50 and 50*a* and bottom edges 40 and 40*a* of sides 14 and 16, respectively, and top edge 54 of end 18 and top edge 68 of end 20 abut against inside surface 92 of top 22.

Likewise, although casket 10 of the preferred embodiment according to the teachings of the present invention is shown as not requiring nails or hardware of any kind, caskets according to the teachings of the present invention can additionally include hardware or nails as desired. For example, screws, nails, or other fastening devices can be used in substitution or in addition to dowels 102 or 104, if acceptable.

Although casket 10 of the preferred embodiment according to the teachings of the present invention includes handle members 106 as disclosed, handle members may be omitted or handle members or other types can be used alone or in addition to handle members 106 as shown in the preferred embodiment of the present invention.

Thus, since the invention disclosed herein may be embodied in other specific forms without departing from the spirit or the general characteristics thereof, some of which forms have been indicated, the embodiments described herein are to be considered in all respects illustrative and not restrictive. The scope of the invention is indicated by the appended claims, rather than by the foregoing description and all changes which come within the meaning and range of equivalency of the claims are intended to be embraced therein.

What is claimed is:

1. Casket comprising, in combination: a bottom including a first side edge, a second side edge, a first end edge, a second end edge, a top surface, and a bottom surface; a first side including a top edge, a bottom edge, a first end edge, a second end edge, an outside surface, and an inside surface; a second side including a top edge, a bottom edge, a first end edge, a second end edge, an outside surface, and an inside surface; a first end including a top edge, a bottom edge, a first side edge, a second side edge, an outside surface, and an inside surface; a second end including a top edge, a bottom edge, a first side edge, a second side edge, an outside surface, and an inside surface; a top including a first side edge, a second side edge, a first end edge, a second end edge, an outside surface, and an inside surface; first means for longitudinally, slidably interlocking the first side to the bottom and for preventing movement of the first side relative to the bottom in all directions other than its longitudinal; second means for longitudinally, slidably interconnecting the second side to the bottom and for preventing movement of the second side relative to the bottom in all directions other than its longitudinal; third means for longitudinally, slidably interconnecting the first end to the first side and for preventing movement of the first end relative to the first side in all directions other than its longitudinal; fourth means for longitudinally, slidably interconnecting the first end to the second side and for preventing movement of the first end relative to the second side in all directions other than its longitudinal; fifth means for longitudinally, slidably interconnecting the second end to the first side and for preventing movement of the second end relative to the first side in all directions other than its longitudinal; sixth means for longitudinally, slidably interlocking the second end to the second side and for preventing movement of the second end relative to the second side in all directions other than its longitudinal; seventh means for longitudinally, slidably interconnecting the top of the first side and for preventing movement of the top relative to the first side in all directions other than its longitudinal; eighth means for longitudinally, slidably interconnecting the top to the second side and for preventing movement of the top relative to the second side in all directions other than its longitudinal, with the bottom, sides, ends, and top interfitting in a fashion that the assembly of the last part locks all preceding parts and prevents movement of the preceding parts in any of their longitudinal directions to form a rigid, unitary, complete casket obviating the necessity of any further fastening elements of any kind.

2. The casket of claim 1 wherein the first through and including the eighth means are formed in the named longitudinally, slidably interlocking parts and of the same material.

3. The casket of claim 2 wherein the first through and including the eighth means comprises, in combination: a dove tailed edge formed on one of the named longitudinally, slidably interlocking parts; and a dove tailed groove for longitudinally slidably receiving the dove tailed edge, formed on the other of the named longitudinally slidably interlocking parts.

4. The casket of claim 3 wherein at least one of the ends interfit with the bottom and sides in the following manner: the bottom further includes a groove formed in the top surface parallel to and slightly spaced from the end edge, with the groove in the bottom having a shape complementary to the bottom edge of the end, with the bottom edge of the end being positioned within the groove of the bottom in the assembled casket for blocking the bottom such that longitudinal movement of the bottom within the sides is prevented and the end is prevented from moving beyond the bottom.

5. The casket of claim 4 wherin one end interfits with the bottom and sides in the following manner: the end further includes a groove formed in the inside surface parallel to and slightly spaced from its bottom edge, with the groove in the end having a shape complementary to the end edge of the bottom, with the end edge of the bottom being positioned within the groove of the end in the assembled casket for blocking the end such that longitudinal movement of the end within the sides is prevented and the bottom is prevented from moving beyond the end.

6. The casket of claim 5 further including handle members comprising, in combination: a rope member having a first end and a second end; a first aperture; a second aperture spaced horizontally from the first aperture, with the first and second apertures being formed in one of the sides; a third aperture; a fourth aperture spaced from the third aperture along a line parallel to the end edges of the bottom and corresponding to the first aperture; a fifth aperture; and a sixth aperture spaced from the fifth aperture along a line parallel to the end edges of the bottom and corresponding to the second aperture, with the third, fourth, fifth, and sixth apertures being formed in the bottom, with the first end of the rope member being locatable within the third aperture and extendable exteriorly of the casket, with the rope member being threadable through the fourth aperture into the interior of the casket, through the first aperture to the exterior of the casket, through the second aperture into the interior of the casket, through the sixth aperture to the exterior of the casket, and with the second end of the rope member locatable in the fifth aperture.

7. The casket of claim 6 further comprising ninth means for blocking longitudinal movement of the last assembled part with respect to the preceding parts.

8. The casket of claim 7 wherein the ninth means comprises, in combination: a first bore formed in the last assembled part; a second bore formed in one of the preceding assembled parts, with the first bore corresponding to the second bore when the casket is in an assembled relation; and a first dowel having a shape corresponding to and for receipt in the first and second bores.

9. The casket of claim 8 wherein the last assembled part is the top.

10. The casket of claim 3 further comprising ninth means for blocking longitudinal movement of the last assembled part with respect to the preceding parts.

11. The casket of claim 10 wherein the ninth means comprises, in combination: a first bore formed in the last assembled part; a second bore formed in one of the preceding assembled parts, with the first bore corresponding to the second bore when the casket is in an assembled relation; and a first dowel having a shape corresponding to and for receipt in the first and second bores.

12. The casket of claim 11 wherein the last assembled part is the top.

13. The casket of claim 3 wherein one end interfits with the bottom and sides in the following manner: the end further includes a groove formed in the inside surface parallel to and slightly spaced from its bottom edge, with the groove in the end having a shape complementary to the end edge of the bottom, with the end edge of the bottom being positioned within the groove of the end in the assembled casket for blocking the end such that longitudinal movement of the end within the sides is prevented and the bottom is prevented from moving beyond the end.

14. The casket of claim 3 further including handle members comprising, in combination: a rope member having a first end and a second end; a first aperture; a second aperture spaced horizontally from the first aperture, with the first and second apertures being formed in one of the sides; a third aperture; a fourth aperture spaced from the third aperture along a line parallel to the end edges of the bottom and corresponding to the first aperture; a fifth aperture; and a sixth aperture spaced from the fifth aperture along a line parallel to the end edges of the bottom and corresponding to the second aperture, with the third, fourth, fifth, and sixth apertures being formed in the bottom, with the first end of the rope member being locatable within the third aperture and extendable exteriorly of the casket, with the rope member being threadable through the fourth aperture into the interior of the casket, through the first aperture to the exterior of the casket, through the second aperture into the interior of the casket, through the sixth aperture to the exterior of the casket, and with the second end of the rope member locatable in the fifth aperture.

15. The casket of claim 3 wherein at least one of the ends interfit with the bottom and sides in the following manner: the end is prevented from moving beyond the bottom edge of the sides, and wherein the end edge of the bottom abuts against the inside surface of the end for blocking the bottom such that the bottom is prevented from moving beyond the end.

16. The casket of claim 3 wherein the dove tailed edges are formed on the side edges of the bottom, the side edges of the ends, and the top edges of the sides.

17. The casket of claim 1 wherein at least one of the ends interfit with the bottom and sides in the following manner: the bottom further includes a groove formed in the top surface parallel to and slightly spaced from the end edge, with the groove in the bottom having a shape complementary to the bottom edge of the end, with the bottom edge of the end being positioned within the groove of the bottom in the assembled casket for blocking the bottom such that longitudinal movement of the bottom within the sides is prevented and the end is prevented from moving beyond the bottom.

18. The casket of claim 1 wherein one end interfits with the bottom and sides in the following manner: the end further includes a groove formed in the inside surface parallel to and slightly spaced from its bottom edge, with the groove in the end having a shape complementary to the end edge of the bottom, with the end edge of the bottom being positioned within the groove of the end in the assembled casket for blocking the end such that logitudinal movement of the end within the sides is prevented and the bottom is prevented from moving beyond the end.

19. The casket of claim 18 wherein at least one of the ends interfit with the bottom and sides in the following manner: the bottom further includes a groove formed in the top surface parallel to and slightly spaced from the end edge, with the groove in the bottom having a shape complementary to the bottom edge of the end, with the bottom edge of the end being positioned within the groove of the bottom in the assembled casket for blocking the bottom such that longitudinal movement of the bottom within the sides is prevented and the end is prevented from moving beyond the bottom.

20. The casket of claim 1 further including handle members comprising, in combination: a rope member having a first end and a second end; a first aperture; a second aperture spaced horizontally from the first aperture, with the first and second apertures being formed in one of the sides; a third aperture; a fourth aperture spaced from the third aperture along a line parallel to the end edges of the bottom and corresponding to the first aperture; a fifth aperture; and a sixth aperture spaced from the fifth aperture along a line parallel to the end edges of the bottom and corresponding to the second aperture, with the third, fourth, fifth, and sixth apertures being formed in the bottom, with the first end of the rope member being locatable within the third aperture and extendable exteriorly of the casket, with the rope member being threadable through the fourth aperture into the interior of the casket, through the first aperture to the exterior of the casket, through the second aperture into the interior of the casket, through the sixth aperture to the exterior of the casket, and with the second end of the rope member locatable in the fifth aperture.

21. The casket of claim 20 wherein at least one of the ends interfit with the bottom and sides in the following manner: the bottom further includes a groove formed in the top surface parallel to and slightly spaced from the end edge, with the groove in the bottom having a shape complementary to the bottom edge of the end, with the bottom edge of the end being positioned within the groove of the bottom in the assembled casket for blocking the bottom such that longitudinal movement of the bottom within the sides is prevented and the end is prevented from moving beyond the bottom.

22. The casket of claim 1 wherein at least one of the ends interfit with the bottom and sides in the following manner: the end is prevented from moving beyond the bottom edge of the sides, and wherein the end edge of the bottom abuts against the inside surface of the end for blocking the bottom such that the bottom is prevented from moving beyond the end.

23. The casket of claim 1 further comprising ninth means for blocking logitudinal movement of the last assembled part with respect to the preceding parts.

24. The casket of claim 23 wherein the ninth means comprises, in combination: a first bore formed in the last assembled part; a second bore formed in one of the preceding assembled parts, with the first bore corresponding to the second bore when the casket is in an assembled relation; and a first dowel having a shape corresponding to and for receipt in the first and second bores.

25. The casket of claim 24 wherein the last assembled part is the top.

* * * * *